US009543679B2

(12) United States Patent
Schmidt et al.

(10) Patent No.: US 9,543,679 B2
(45) Date of Patent: Jan. 10, 2017

(54) ELECTRICAL CONTACT ASSEMBLY

(71) Applicants: Tyco Electronics Corporation, Berwyn, PA (US); Tyco Electronics AMP GMBH, Bensheim (DE)

(72) Inventors: Helge Schmidt, Speyer (DE); Michael Leidner, Lambrecht/Pfalz (DE); Marjorie Myers, Mount Wolf, PA (US)

(73) Assignees: TYCO ELECTRONICS CORPORATION, Berwyn, PA (US); TE CONNECTIVITY GERMANY GMBH, Bensheim (DE)

( * ) Notice: Subject to any disclaimer, the term of this patent is extended or adjusted under 35 U.S.C. 154(b) by 259 days.

(21) Appl. No.: 13/841,449

(22) Filed: Mar. 15, 2013

(65) Prior Publication Data

US 2014/0099803 A1 Apr. 10, 2014

Related U.S. Application Data

(60) Provisional application No. 61/710,323, filed on Oct. 5, 2012.

(51) Int. Cl.

| | |
|---|---|
| ***H01H 1/06*** | (2006.01) |
| ***H01R 13/22*** | (2006.01) |
| ***H01H 3/12*** | (2006.01) |
| ***H01R 13/24*** | (2006.01) |
| ***H01H 1/10*** | (2006.01) |
| *H01H 13/48* | (2006.01) |

(52) U.S. Cl.

CPC ..... *H01R 13/22* (2013.01); *H01H 1/06* (2013.01); *H01H 1/10* (2013.01); *H01H 3/125* (2013.01); *H01R 13/2478* (2013.01); *H01R 13/2485* (2013.01); *H01R 13/2492* (2013.01); *H01H 13/48* (2013.01)

(58) Field of Classification Search

CPC H01H 1/06; H01H 2203/024; H01H 2203/04; H01R 13/24

USPC 200/276, 406, 279, 516, 275, 513; 361/773; 257/E23.078; 438/884

See application file for complete search history.

(56) References Cited

U.S. PATENT DOCUMENTS

| | | | | |
|---|---|---|---|---|
| 5,329,423 | A * | 7/1994 | Scholz | 361/760 |
| 6,423,918 | B1 * | 7/2002 | King et al. | 200/406 |
| 7,365,280 | B2 * | 4/2008 | Nishikawa et al. | 200/279 |
| 7,687,735 | B2 * | 3/2010 | Chien et al. | 200/515 |
| 8,021,200 | B2 | 9/2011 | Myer | |

(Continued)

FOREIGN PATENT DOCUMENTS

| | | | |
|---|---|---|---|
| WO | 9423475 | A1 | 10/1994 |
| WO | 2005015692 | A1 | 2/2005 |

OTHER PUBLICATIONS

International Search Report, International Application No. PCT/US2013/059864, International Filing Date, Sep. 2013.

*Primary Examiner* — Renee Luebke
*Assistant Examiner* — Ahmed Saeed

(57) ABSTRACT

An electrical contact assembly includes a first electrical contact having a first mating element, and a second electrical contact having a second mating element. The first and second electrical contacts being configured to mate together at the first and second mating elements such that the first and second mating elements engage each other at a contact interface. A distribution of contact pressure across the contact interface at least partially coincides with a distribution of electrical current flow across the contact interface.

26 Claims, 7 Drawing Sheets

(56) References Cited

U.S. PATENT DOCUMENTS

| | | | | |
|---|---|---|---|---|
| 8,188,392 | B2 * | 5/2012 | Isberg | H01H 1/06 200/279 |
| 2003/0092294 | A1 | 5/2003 | Matsunaga | |
| 2006/0205290 | A1 | 9/2006 | Narita | |
| 2008/0136039 | A1 * | 6/2008 | Eppler | 257/774 |
| 2012/0315806 | A1 | 12/2012 | Myer | |

* cited by examiner

ELECTRICAL CONTACT ASSEMBLY

CROSS-REFERENCE TO RELATED APPLICATIONS

This application is a non-provisional application that claims priority to and the benefit of the filing date of U.S. Provisional Application No. 61/710,323, filed on Oct. 5, 2012, and entitled "ELECTRICAL CONTACT ASSEMBLY".

BACKGROUND OF THE INVENTION

The subject matter described and/or illustrated herein relates generally to electrical contacts, and more particularly, to an assembly of mated electrical contacts.

Complementary electrical contacts are configured to mate together at a contact interface where mating elements of the complementary electrical contacts engage (i.e., physically contact) each other. Many electrical contact assemblies form a Hertzian style contact interface when the mating elements of the complementary electrical contacts engage each other. Hertzian contact interfaces are formed when the mating element of one of the complementary electrical contacts includes a curved surface that engages a curved or approximately flat surface of the mating element of the other complementary electrical contact. The curved surface(s) deforms slightly under the contact force that holds the mating elements in engagement. For example, a Hertzian style contact interface is formed when a mating element in the form of a spherical protrusion engages an approximately flat (i.e., planar) surface of the mating element of the complementary electrical contact.

Hertzian contact interfaces are not without disadvantages. For example, the mechanical and electrical distributions across the Hertzian contact interface are typically not coincident. Specifically, the regions within the Hertzian contact interface having the greatest mechanical contact pressure (i.e., the greatest normal load or the greatest normal pressure) have different locations within the Hertzian contact interface than the regions within the Hertzian contact interface that carry the greatest amount of electrical current (i.e., the greatest current density). For example, the maximum mechanical contact pressure may be located at the center of the Hertzian contact interface, while the maximum amount of electrical current is distributed across the outer perimeter of the Hertzian contact interface. As a result of the mechanical and electrical distributions not being coincident, only a portion (e.g., a minority) of the area of the Hertzian contact interface is contributing to the flow of electrical current, which may lead to greater overall contact resistance and/or a greater localized thermal response.

Moreover, in situations wherein a shear force is applied to the Hertzian contact interface (e.g., from vibrational and/or thermal effects), mechanical degradation of the Hertzian contact interface will first occur where the lateral deformation is the greatest but the mechanical contact pressure is the lowest. In other words, shear forces may cause the Hertzian contact interface to mechanically degrade (e.g., break, fracture, wear, and/or the like) first at the regions that carry the greatest amount of electrical current, which may reduce the amount of electrical current that is carried by the Hertzian contact interface to fall below desired levels and/or may cause the electrical contacts to completely lose electrical contact therebetween. Shear forces may be especially problematic for Hertzian contact interfaces that are formed from electrical contacts that include non-noble metal coatings (e.g., Sn), which may require a higher normal load to penetrate the inherent oxide film that forms on non-noble metal coatings.

BRIEF DESCRIPTION OF THE INVENTION

In one embodiment, an electrical contact assembly includes a first electrical contact having a first mating element, and a second electrical contact having a second mating element. The first and second electrical contacts being configured to mate together at the first and second mating elements such that the first and second mating elements engage each other at a contact interface. A distribution of contact pressure across the contact interface at least partially coincides with a distribution of electrical current flow across the contact interface.

In another embodiment, an electrical contact assembly includes a first electrical contact having a first mating element, and a second electrical contact having a second mating element. The first and second electrical contacts are configured to mate together at the first and second mating elements such that the first and second mating elements engage each other at a contact interface. The contact interface includes a first asperity junction where the contact interface has the greatest current density and a second asperity junction where the contact interface has the greatest normal load, the first and second asperity junctions at least partially overlapping each other.

In another embodiment, an electrical contact assembly includes a first electrical contact having a first mating element, and a second electrical contact having a second mating element. The first and second electrical contacts are configured to mate together at the first and second mating elements such that the first and second mating elements engage each other at a contact interface. The first mating element and/or the second mating element has a periodic surface topology that includes approximately parallel valleys that are separated by peaks. The first and second mating elements are configured to engage each other at the peaks of the periodic surface topology such that the contact interface is at least partially defined by the peaks.

DETAILED DESCRIPTION OF THE INVENTION

Figure 1:
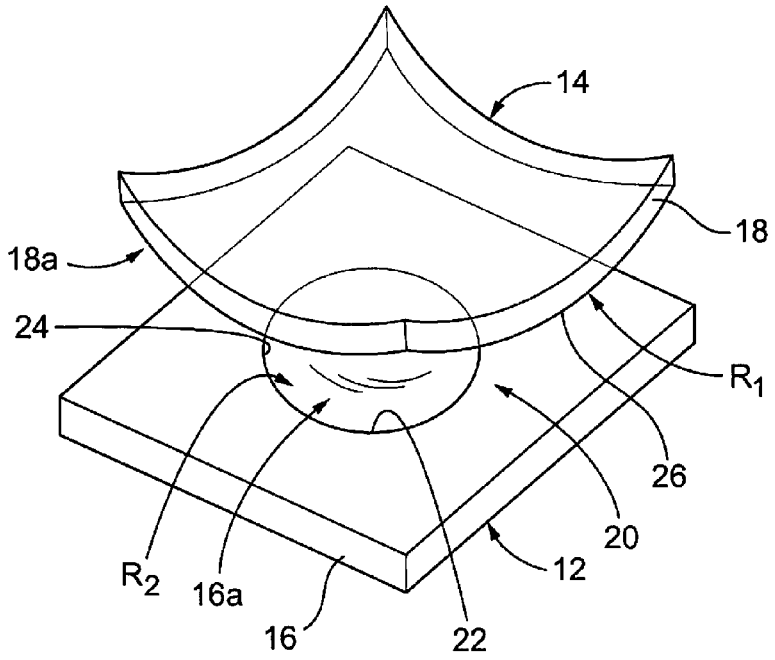
FIG. 1 is an exploded perspective view of an exemplary embodiment of an electrical contact assembly.
Figure 2:
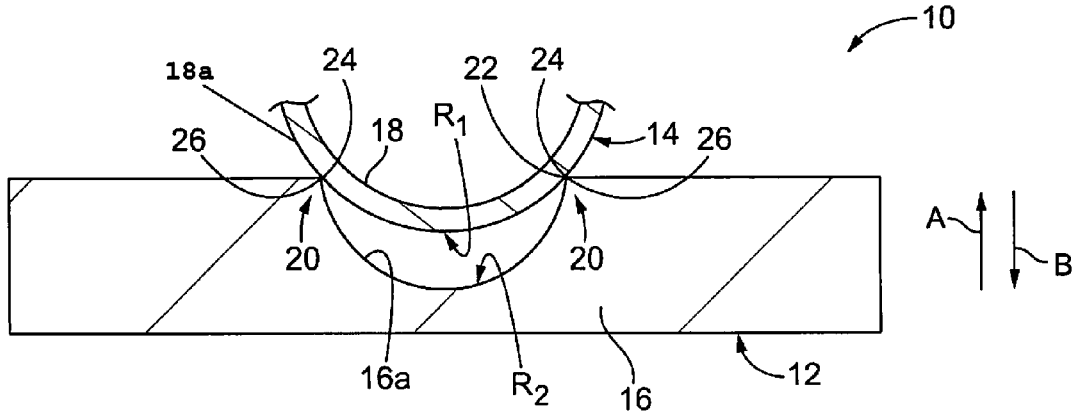
FIG. 2 is a cross-sectional view of the electrical contact assembly shown in FIG. 1.

FIG. 1 is an exploded perspective view of an exemplary embodiment of an electrical contact assembly 10. FIG. 2 is a cross-sectional view of the electrical contact assembly 10. Referring now to FIGS. 1 and 2, the assembly 10 includes a pair of complementary electrical contacts 12 and 14 that mate together to establish an electrical connection therebetween. The electrical contacts 12 and 14 may each be a component of any device, such as, but not limited to, an electrical connector (not shown), a printed circuit board (not shown), an electrical wire (not shown), an electrical cable (not shown), an electrical power source (not shown), and/or the like. The electrical contacts 12 and 14 may each be referred to herein as a "first" and/or a "second" electrical contact.

The electrical contacts 12 and 14 include mating elements 16 and 18, respectively. The electrical contacts 12 and 14 mate together at the mating elements 16 and 18. Specifically, the mating elements 16 and 18 engage each other to mate the electrical contacts 12 and 14 together. The mating elements 16 and 18 may be elements of larger segments of the electrical contacts 12 and 14, respectively. For example, the mating elements 16 and 18 may be elements of mating segments (e.g., arms, beams, fingers, plugs, receptacles, and/or the like) of the respective electrical contacts 12 and 14. The electrical contacts 12 and 14 may include other segments (not shown) in addition to mating segments, such as, but not limited to, mounting segments, termination segments, intermediate segments, housing segments, and/or the like. Each of the mating elements 16 and 18 may be referred to herein as a "first" and/or a "second" mating element.

The mating elements 16 and 18 engage each other at a contact interface 20, which is best seen in FIG. 2 and will be described in more detail below. The contact interface 20 is defined by the surface regions of the mating elements 16 and 18 that engage each other. The contact interface 20 may include one or more segments where the surface regions of the mating elements 16 and 18 engage each other. In the exemplary embodiment of the assembly 10, the contact interface 20 is defined by a single continuous segment where the surface regions of the mating elements 16 and 18 engage each other. But, in other embodiments, the contact interface 20 may be defined by two or more discrete segments where the surface regions of the mating elements 16 and 18 engage each other.

In the exemplary embodiment of the assembly 10, the mating element 16 of the electrical contact 12 includes a depression 16*a* and the mating element 18 of the electrical contact 14 includes a protrusion 18*a*. The protrusion 18*a* is configured to be partially received into the depression when the mating elements 16 and 18 are engaged (i.e., when the electrical contacts 12 and 14 are mated together). In the exemplary embodiment of the assembly 10, the protrusion 18*a* and the depression 16*a* are each curved and the protrusion 18*a* has a greater radius of curvature $R_1$ than the radius of curvature $R_2$ of the depression 16*a*. Accordingly, the protrusion 18*a* is configured to be only partially received within the depression 16*a*. The protrusion 18*a* may be referred to herein as a "curved protrusion", while the depression 16*a* may be referred to herein as a "curved depression".

The protrusion 18*a* of the mating element 18 and the depression 16*a* of the mating element 16 may each have any respective radius of curvature $R_1$ and $R_2$ that enables the mating elements 18 and 16 to function as described and/or illustrated herein. Moreover, the radius of curvature $R_1$ of the protrusion 18*a* may be greater than the radius of curvature $R_2$ of the depression 16*a* by any amount that enables the mating elements 16 and 18 to function as described and/or illustrated herein.

In the exemplary embodiment of the assembly 10, the depression 16*a* and the protrusion 18*a* each have a spherical shape. Specifically, the depression 16*a* and the protrusion 18*a* each have the shape of a partial sphere. Although shown as each defining less than half of a sphere, the depression 16*a* and the protrusion 18*a* may each define any other amount (e.g., approximately half) of a sphere. Moreover, the depression 16*a* and the protrusion 18*a* may each have other curved shapes besides spherical shapes, such as, but not limited to, a non-circular shape, an oval shape, a parabolic shape, a curved shape that includes a varying radius of curvature, and/or the like. The depression 16*a* may be referred to herein as a "spherical depression", while the protrusion 18*a* may be referred to herein as a "spherical protrusion".

The depression 16*a* includes a rim 22. As will be described below, the rim 22 defines a portion of the contact interface 20. The mating elements 16 and 18 of the assembly 10 define a "rim only" geometry wherein the mating element 16 only engages the mating element 18 at the rim 22. In other words, the rim 22 defines the entirety of the portion of the contact interface 20 that is defined by the mating element 16. In the exemplary embodiment of the assembly 10, the rim 22 is circular because the depression 16*a* is spherical. But, the rim 22 may have other curved shapes (e.g., an oval shape, a parabolic shape, and/or the like). Moreover, the depression 16*a* and the protrusion 18*a* are not limited to curved shapes. Rather, the depression 16*a* and the protrusion 18*a* may each additionally or alternatively include any other shape, such as, but not limited to, rectangular cross-sectional shapes, square cross-sectional shapes, cross-sectional shapes having more than four sides, triangular cross-sectional shapes, and/or the like. The rim 22 may thus include non-curved shapes (e.g., square shapes, rectangular shapes, triangular shapes, more than four sided shapes, and/or the like) in addition or alternative to one or more curved shapes. In embodiments wherein the depression 16*a* and/or the protrusion 18*a* include non-curved shapes, the relative sizes of the depression 16*a* and the protrusion 18*a* may be selected to provide a rim only geometry at the contact interface 20.

As best seen in FIG. 2, when the electrical contacts 12 and 14 are mated together, the mating elements 16 and 18 are engaged at the contact interface 20. Specifically, a surface region 26 of the protrusion 18*a* is engaged with a surface region 24 of the depression 18*a*. The contact interface 20 is defined by the surface regions 24 and 26 where the depression 16*a* and the protrusion 18*a*, respectively, engage each other. The surface region 24 of the depression 16*a* is entirely defined by the rim 22 of the depression 16*a*. The rim 22 thus defines the portion of the contact interface 20 that is defined by the depression 16*a* such that the contact interface is partially defined by the rim 22. Because the surface region 24 of the depression 16*a* is entirely defined by the rim 22, the contact interface 20 has the "rim only" geometry discussed above.

The mating elements 16 and 18 may each be formed from any materials. In some embodiments, exterior surfaces of the mating elements 16 and/or 18 are defined by non-noble (e.g., Sn) and/or noble metal coatings. Examples of base materials and/or surface coating materials of each of the mating elements 16 and 18 include, but are not limited to, noble metals, non-noble metals, copper (Cu), copper alloys, aluminum (Al), aluminum alloys, zinc (Zn), zinc alloys, iron (Fe), iron alloys (including stainless steels), nickel (Ni), nickel alloys, silver (Ag), silver alloys, Bi, Bi alloys, gold (Au), gold alloys, tin (Sn), tin alloys, gold over palladium (Pd), gold over PdNi alloy, gold over NiP alloy, Au/NiP metallurgical combinations (e.g., AgNi, AgW, AgSnO, AgCdO, AgCu, and/or the like) and/or the like. In some embodiments, the mating elements 16 and 18 are formed from the substantially the same materials (e.g., have substantially similar surface coatings), while in other embodiments the mating elements 16 and 18 are formed from different materials. The mating elements 16 and 18 may be formed from any method, process, operation, and/or the like, such as, but not limited to, wire drawing operations and/or the like.

Figure 3:
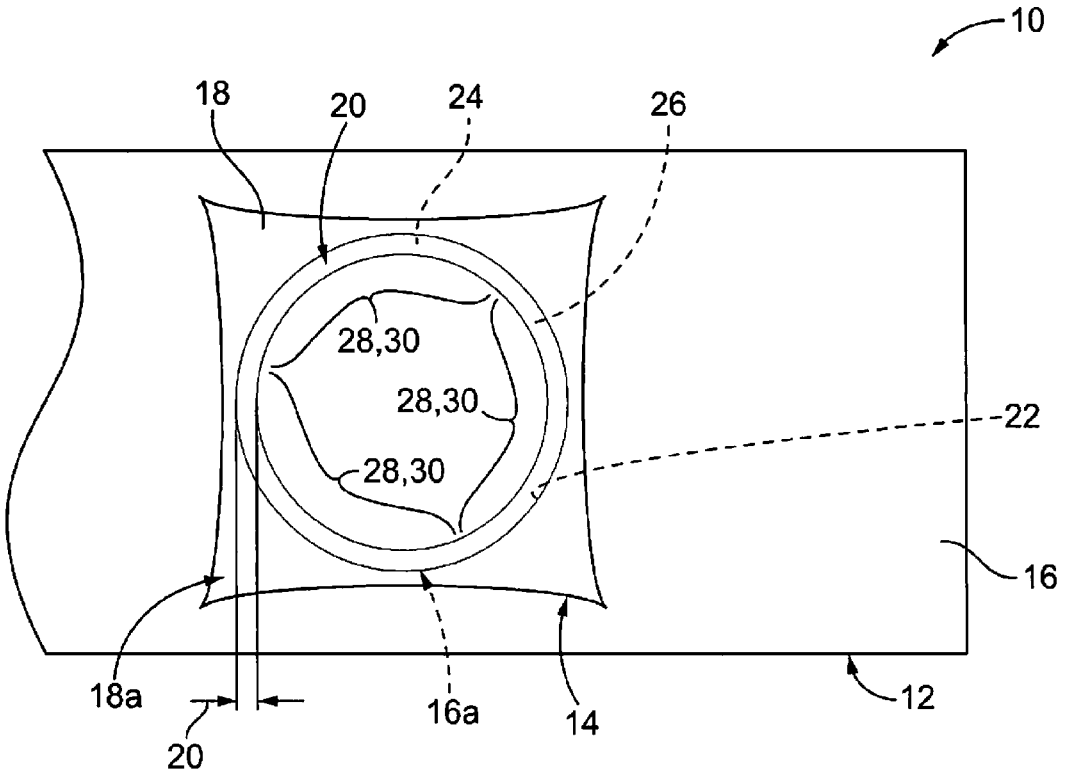
FIG. 3 is a plan view of the electrical contact assembly shown in FIGS. 1 and 2 illustrating an exemplary embodiment of a contact interface of the assembly.

FIG. 3 is a plan view of the electrical contact assembly 10 illustrating the contact interface 20. The surface region 26 of the protrusion 18*a* of the mating element 18 is engaged with the rim 22 of the depression 16*a* of the mating element 16. The contact interface 20 may include a distribution of electrical energy and mechanical contact pressure forces along the contact interface 20. Such a distribution includes asperity junctions (also commonly referred to as "a-spots") 28 where the contact interface 20 carries the greatest amount of electrical current and asperity junctions 30 where the contact interface 20 has the greatest mechanical contact pressure. The amount of electrical current carried by the contact interface may also be referred to herein and commonly as the "current density", while mechanical contact pressure may be referred to herein and commonly as "normal load" and/or "normal pressure". Electrical energy may be referred to herein as "electrical current flow". The mechanical contact pressure acts in the directions of the arrows A and B in FIG. 2.

As can be seen in FIG. 3, the asperity junctions 28 and the asperity junctions 30 overlap (i.e., coincide with) each other. Accordingly, the mechanical distribution of mechanical pressure forces along the contact interface 20 coincides with the electrical distribution of electrical energy along the contact interface 20. In other words, the location(s) along the contact interface 20 where the current density is the greatest (i.e., the asperity junctions 28) overlap the location(s) along the contact interface 20 where the normal pressure is the greatest (i.e., the asperity junctions 30).

For example, the asperity junctions 28 and 30 may overlap each other because the contact interface 20 has been more isolated (i.e., localized) to the surface regions 24 and 26 as compared to the broader surface areas of Hertzian contact interfaces of similarly sized mating elements. Moreover, because no mechanical contact is present inside the rim 22, the outer portion of the contact interface 20 experiences significantly higher surface pressure values, which results in higher deformation of the asperity junctions 28 and 30 and thereby leads to more effective disruption of any surface oxide/contamination films.

In the exemplary embodiment of the assembly 10, the asperity junctions 28 and 30 entirely overlap each other, such that the asperity junction 28 does not include any portion that does not overlap the asperity junction 30, and vice versa. In other words, the mechanical distribution of mechanical pressure forces along the contact interface 20 completely coincides with the electrical distribution of electrical energy along the contact interface 20. But, in other embodiments, the asperity junctions 28 and 30 only partially overlap each other, such that the asperity junction 28 includes a portion that does not overlap the asperity junction 30, and/or vice versa. In other words, the mechanical distribution of mechanical pressure forces along the contact interface 20 may only partially coincide with the electrical distribution of electrical energy along the contact interface 20. The area of the contact interface 20, the relative size difference between the protrusion 18*a* and the depression 16*a* (e.g., the difference between the radii of curvature $R_1$ and $R_2$), and/or the like may be selected to provide the asperity junctions 28 and 30 as at least partially overlapping.

Figure 4:
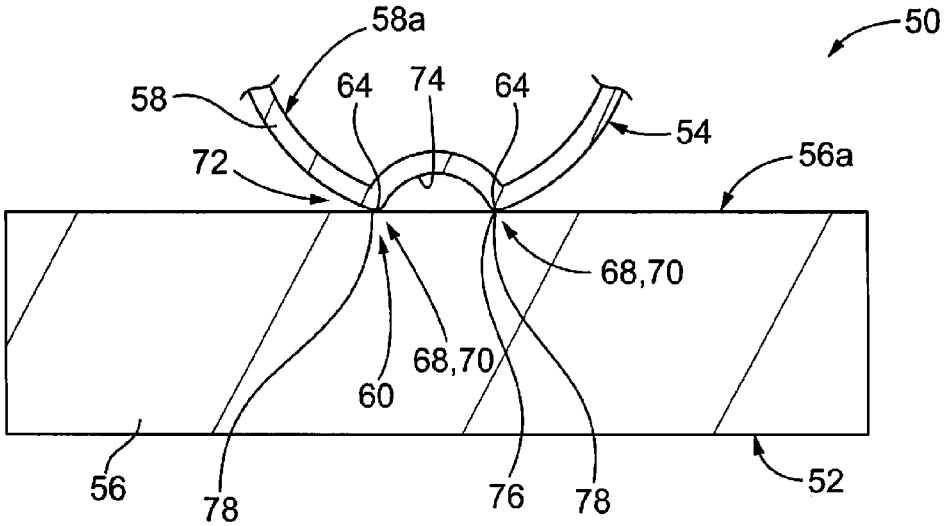
FIG. 4 is a cross-sectional view of another exemplary embodiment of an electrical contact assembly.

FIG. 4 is a cross-sectional view of another exemplary embodiment of an electrical contact assembly 50. The assembly 50 includes a pair of complementary electrical contacts 52 and 54 that mate together to establish an electrical connection therebetween. The electrical contacts 52 and 54 mate together at respective mating elements 56 and 58 thereof that engage each other at a contact interface 60 to mate the electrical contacts 52 and 54 together. The electrical contacts 52 and 54 may each be referred to herein as a "first" and/or a "second" electrical contact. Each of the mating elements 56 and 58 may be referred to herein as a "first" and/or a "second" mating element.

In the exemplary embodiment of the assembly 50, the mating element 56 of the electrical contact 52 includes an approximately planar surface 56*a* and the mating element 58 of the electrical contact 54 includes a protrusion 58*a*. The protrusion 58*a* includes a tip 72 having a depression 74 extending therein. The depression 74 includes a rim 76. In the exemplary embodiment of the assembly 50, the depression 74 has a spherical shape, but the depression 74 may have other curved shapes besides spherical shapes, such as, but not limited to, a non-circular shape, an oval shape, a parabolic shape, a curved shape that includes a varying radius of curvature, and/or the like. In the exemplary embodiment of the assembly 50, the rim 76 is circular because the depression 74 is spherical. But, the rim 76 may have other curved shapes (e.g., an oval shape, a parabolic shape, and/or the like). Moreover, the depression 74 and rim 76 are not limited to curved shapes. Rather, the depression 74 may additionally or alternatively include any other shape, such as, but not limited to, rectangular cross-sectional shapes, square cross-sectional shapes, cross-sectional shapes having more than four sides, triangular cross-sectional shapes, and/or the like. The rim 76 may thus include non-curved shapes (e.g., square shapes, rectangular shapes, triangular shapes, more than four sided shapes, and/or the like) in addition or alternative to one or more curved shapes. The protrusion 58*a* may be referred to herein as a "curved protrusion" and/or a "spherical protrusion". The depression 74 may be referred to herein as a "spherical depression" and/or a "curved depression".

When the electrical contacts 52 and 54 are mated together, the mating elements 56 and 58 are engaged at the contact interface 60 such that the protrusion 58*a* engages a surface region 64 of the surface 56*a* of the mating element 56 at the rim 76 of the depression 74. Specifically, a surface region 78 of the protrusion 58*a* is engaged with the surface region 64 of the surface 56*a* of the mating element 56. The contact interface 20 is defined by the surface regions 78 and 64. The surface region 78 of the protrusion 58*a* is entirely defined by the rim 76 of the depression 74 such that the contact interface 60 has the "rim only" geometry discussed above.

The contact interface 60 may include a distribution of electrical energy and mechanical pressure forces along the contact interface 60. Such a distribution includes asperity junctions 68 where the contact interface 60 carries the greatest amount of electrical current and asperity junctions 70 where the contact interface 60 has the greatest mechanical contact pressure. The asperity junctions 68 and the asperity junctions 70 overlap (i.e., coincide with) each other. Accordingly, the mechanical distribution of mechanical pressure forces along the contact interface 60 coincides with the electrical distribution of electrical energy along the contact interface 60. In the exemplary embodiment of the assembly 50, the asperity junctions 68 and 70 entirely overlap each other. But, in other embodiments, the asperity junctions 68 and 70 only partially overlap each other.

Figure 5:
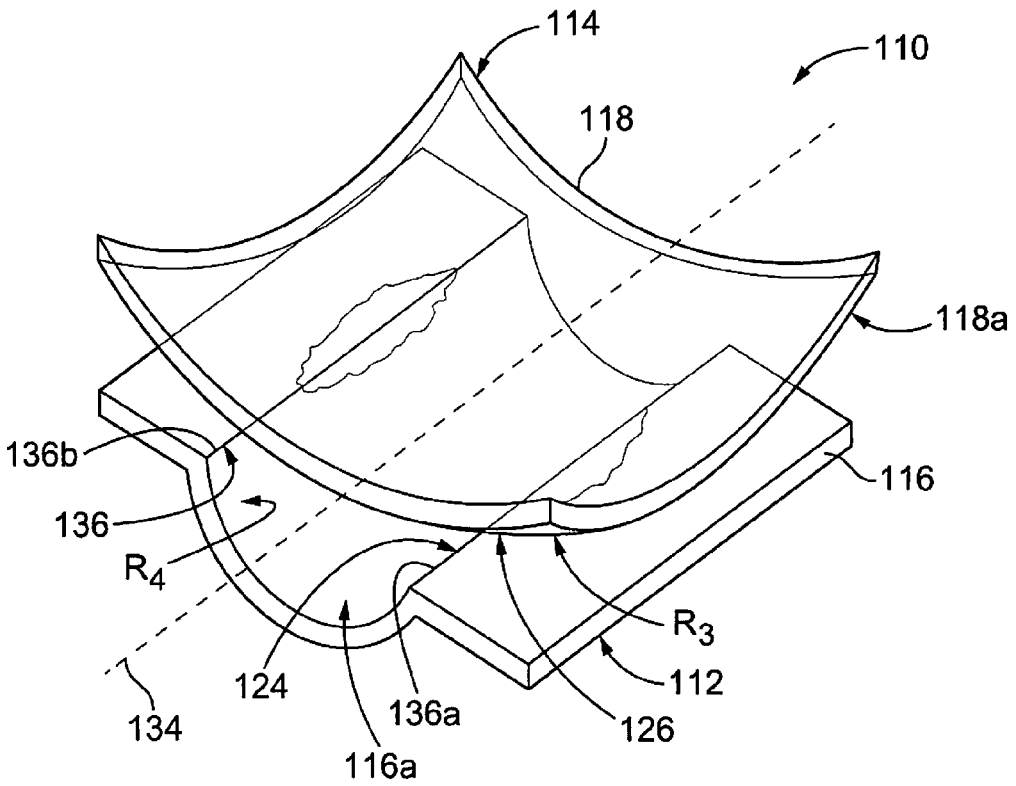
FIG. 5 is a perspective view of another exemplary embodiment of an electrical contact assembly.
Figure 6:
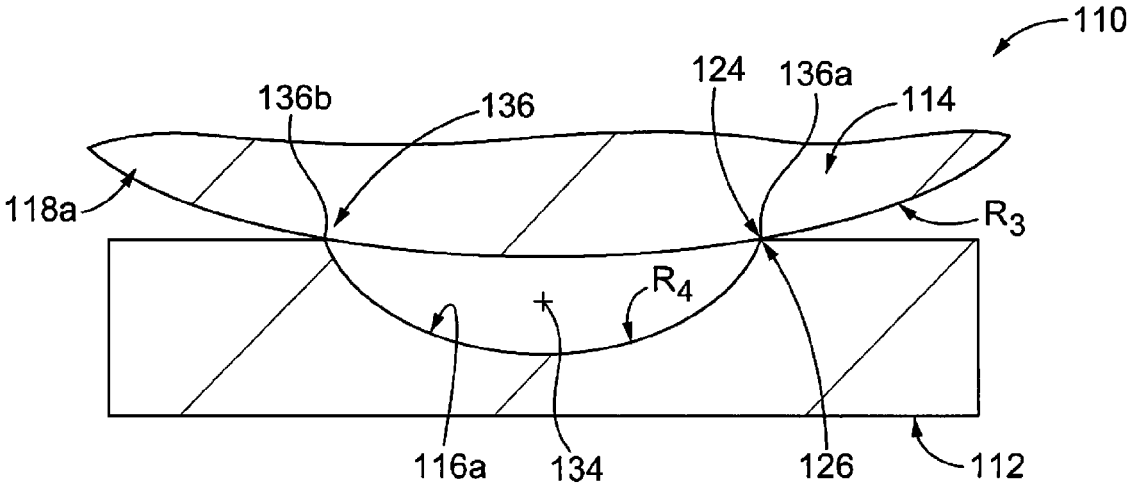
FIG. 6 is a cross-sectional view of the electrical contact assembly shown in FIG. 5.

FIG. 5 is a perspective view of another exemplary embodiment of an electrical contact assembly 110. FIG. 6 is a cross-sectional view of the electrical contact assembly 110. Referring now to FIGS. 5 and 6, the assembly 10 includes a pair of complementary electrical contacts 112 and 114 that mate together to establish an electrical connection therebetween. The electrical contacts 112 and 114 include mating elements 116 and 118, respectively, that engage each other at a contact interface 120 to mate the electrical contacts 112 and 114 together. The electrical contacts 112 and 114 may each be referred to herein as a "first" and/or a "second" electrical contact. Each of the mating elements 116 and 118 may be referred to herein as a "first" and/or a "second" mating element.

The mating element 116 of the electrical contact 112 includes a groove 116*a* that extends a length along the mating element 116. The groove 116*a* extends the length along a central longitudinal axis 134. The groove 116*a* includes a rim 136 that extends along the length of the groove 116*a*. The rim 136 is defined by opposite rim segments 136*a* and 136*b*. The mating element 118 of the electrical contact 114 includes a protrusion 118*a*. The protrusion 118*a* is configured to be partially received into the groove 116*a* when the mating elements 116 and 118 are engaged. In the exemplary embodiment of the assembly 110, the protrusion 118*a* and the groove 116*a* are curved. The protrusion 118*a* has a greater radius of curvature $R_3$ than the radius of curvature $R_4$ of the groove 116*a*. The protrusion 118*a* and the groove 116*a* may each have any respective radius of curvature $R_3$ and $R_4$ that enables the mating elements 118 and 116 to function as described and/or illustrated herein. Moreover, the radius of curvature $R_3$ of the protrusion 118*a* may be greater than the radius of curvature $R_4$ of the depression 116*a* by any amount that enables the mating elements 116 and 118 to function as described and/or illustrated herein. The protrusion 118*a* may be referred to herein as a "curved protrusion" and/or a "spherical protrusion", while the groove 116*a* may be referred to herein as a "cylindrical groove".

The groove 116*a* and the protrusion 118*a* may each have other curved shapes besides the respective cylindrical and spherical shapes shown, such as, but not limited to, a non-circular shape, an oval shape, a parabolic shape, a curved shape that includes a varying radius of curvature, and/or the like. Moreover, the groove 116*a* and the protrusion 118*a* are not limited to curved shapes. Rather, the groove 116*a* and the protrusion 118*a* may each additionally or alternatively include any other shape, such as, but not limited to, rectangular cross-sectional shapes, square cross-sectional shapes, cross-sectional shapes having more than four sides, triangular cross-sectional shapes, and/or the like. In embodiments wherein the groove 116*a* and/or the protrusion 118*a* include non-curved shapes, the relative sizes of the groove 116*a* and the protrusion 118*a* may be selected to provide a rim only geometry at the contact interface 120.

When the electrical contacts 112 and 114 are mated together, a surface region 126 of the protrusion 118*a* is engaged with the rim 136 of the groove 116*a*. The contact interface 120 is defined by the surface regions 124 and 126 where the groove 116*a* and the protrusion 118*a*, respectively, engage each other. The surface region 124 of the groove 116*a* is entirely defined by the rim 136, such that the contact interface 120 has the "rim only" geometry discussed above.

The contact interface 120 may include a distribution of electrical energy and mechanical pressure forces along the contact interface 120. Such a distribution includes asperity junctions 128 where the contact interface 120 carries the greatest current density and asperity junctions 130 where the contact interface 120 has the greatest normal pressure. As best seen in FIG. 5, the asperity junctions 128 and the asperity junctions 130 overlap each other such that the mechanical distribution of normal pressure forces along the contact interface 120 coincides with the electrical distribution of electrical energy along the contact interface 120. In the exemplary embodiment of the assembly 110, the asperity junctions 128 and 130 entirely overlap each other. But, in other embodiments, the asperity junctions 128 and 130 only partially overlap each other.

Figure 7:
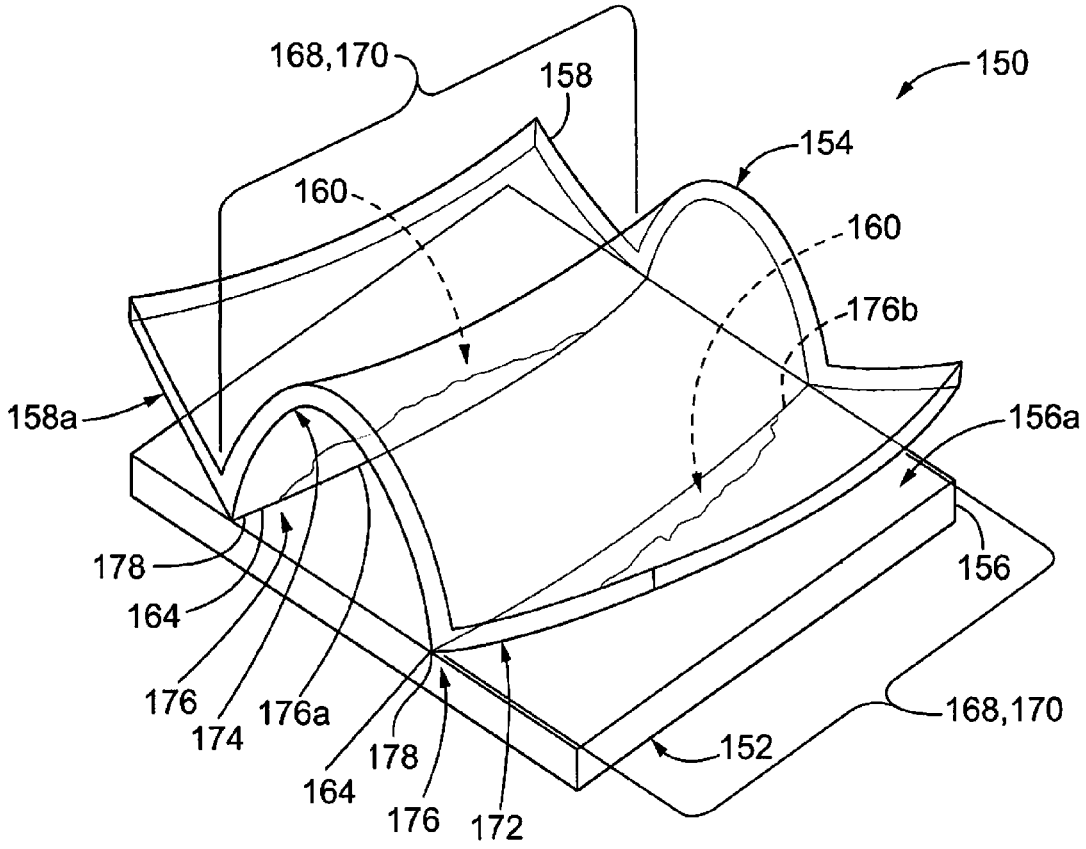
FIG. 7 is a perspective view of another exemplary embodiment of an electrical contact assembly.
Figure 8:
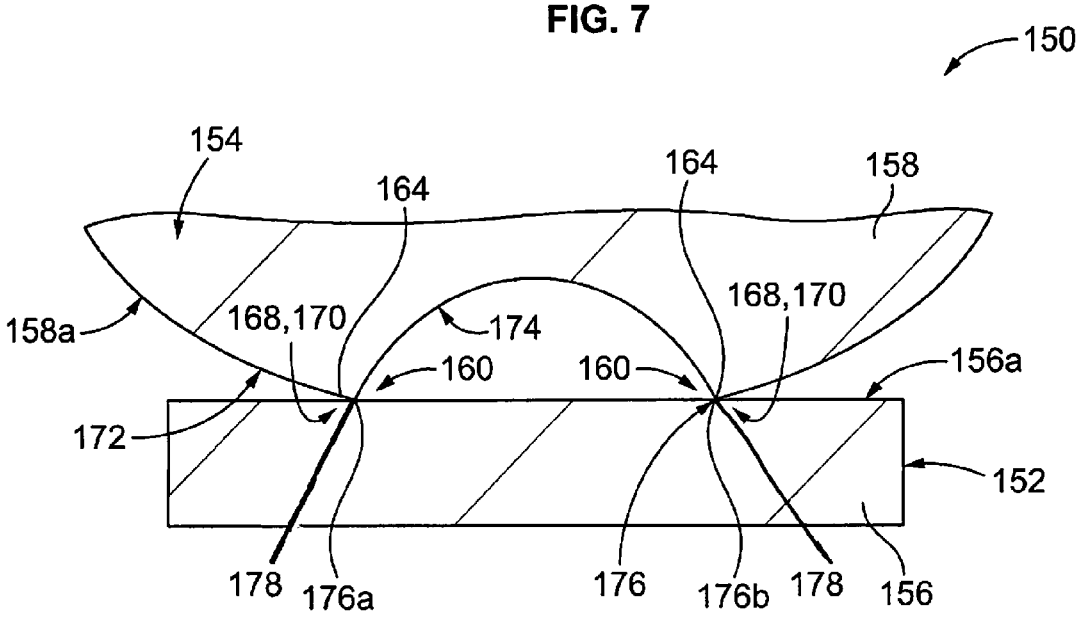
FIG. 8 is a cross-sectional view of the electrical contact assembly shown in FIG. 7.

FIG. 7 is a perspective view of another exemplary embodiment of an electrical contact assembly 150. FIG. 8 is a cross-sectional view of the electrical contact assembly 150. The assembly 150 includes a pair of complementary electrical contacts 152 and 154 having respective mating elements 156 and 158 that engage each other at a contact interface 160 to mate the electrical contacts 152 and 154 together. The electrical contacts 152 and 154 may each be referred to herein as a "first" and/or a "second" electrical contact. Each of the mating elements 156 and 158 may be referred to herein as a "first" and/or a "second" mating element.

The mating element 156 includes an approximately planar surface 156*a* and the mating element 158 includes a protrusion 158*a*. The protrusion 158*a* includes a tip 172 having a groove 174 extending a length along the tip 172. The groove 174 includes a rim 176 that extends along the length of the groove and is defined by opposite rim segments 176*a* and 176*b*. In the exemplary embodiment of the assembly 150, the groove 174 has a cylindrical shape, but the groove 174 may have other curved shapes besides cylindrical shapes, such as, but not limited to, a non-circular shape, an oval shape, a parabolic shape, a curved shape that includes a varying radius of curvature, and/or the like. Moreover, the groove 174 is not limited to curved shapes. Rather, the groove 174 may additionally or alternatively include any other shape, such as, but not limited to, rectangular cross-sectional shapes, square cross-sectional shapes, cross-sectional shapes having more than four sides, triangular cross-sectional shapes, and/or the like. The protrusion 158*a* may be referred to herein as a "curved protrusion" and/or a "spherical protrusion". The groove 174 may be referred to herein as a "cylindrical groove".

When the electrical contacts 152 and 154 are mated together, the mating elements 156 and 158 are engaged at the contact interface 160 such that the protrusion 158*a* engages a surface region 164 of the surface 156*a* of the mating element 156 at the rim 176 of the groove 174. Specifically, a surface region 178 of the protrusion 158*a* is engaged with the surface region 164 of the surface 156*a* of the mating element 156. The contact interface 160 is defined by the surface regions 178 and 164. The surface region 178 of the protrusion 158*a* is entirely defined by the rim 176 of the depression 174 such that the contact interface 160 has the "rim only" geometry discussed above.

The contact interface 160 may include a distribution of electrical energy and mechanical pressure forces along the contact interface 160. Such a distribution includes asperity junctions 168 where the contact interface 160 carries the greatest amount of electrical current and asperity junctions 170 where the contact interface 160 has the greatest mechanical contact pressure. The asperity junctions 168 and the asperity junctions 170 overlap each other. Accordingly, the mechanical distribution of mechanical pressure forces along the contact interface 160 coincides with the electrical distribution of electrical energy along the contact interface 160. In the exemplary embodiment of the assembly 150, the asperity junctions 168 and 170 entirely overlap each other. But, in other embodiments, the asperity junctions 168 and 170 only partially overlap each other.

Figure 9:
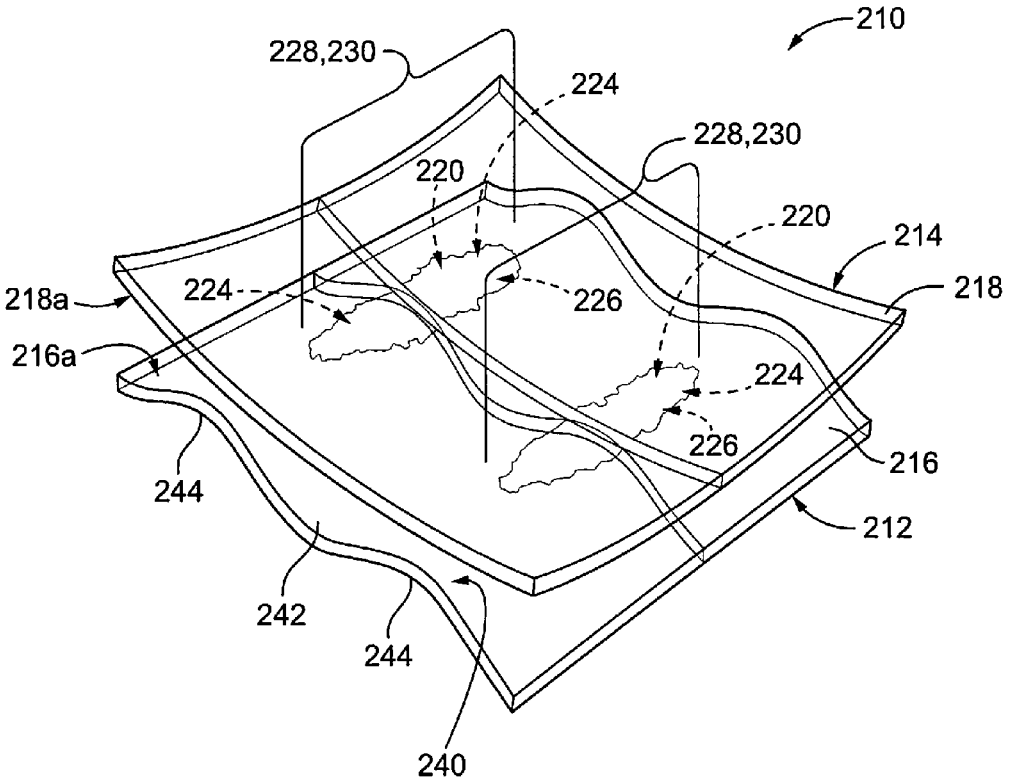
FIG. 9 is a perspective view of another exemplary embodiment of an electrical contact assembly.
Figure 10:
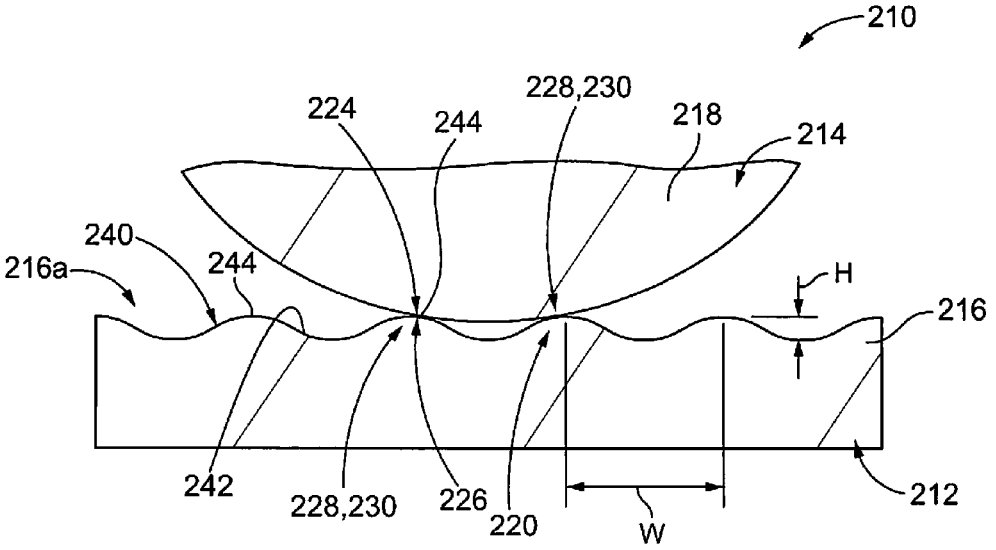
FIG. 10 is a cross-sectional view of the electrical contact assembly shown in FIG. 9.

FIG. 9 is a perspective view of another exemplary embodiment of an electrical contact assembly 210. FIG. 10 is a cross-sectional view of the electrical contact assembly 210. The assembly 210 includes a pair of complementary electrical contacts 212 and 214 that include respective mating elements 216 and 218 that engage each other at a contact interface 220 to mate the electrical contacts 212 and 214 together. The electrical contacts 212 and 214 may each be referred to herein as a "first" and/or a "second" electrical contact. Each of the mating elements 216 and 218 may be referred to herein as a "first" and/or a "second" mating element. The protrusion 218*a* may be referred to herein as a "curved protrusion" and/or a "spherical protrusion".

The mating element 218 of the electrical contact 214 includes a protrusion 218*a*. The mating element 216 of the electrical contact 212 includes a mating side 216*a* having a periodic surface topology 240 that includes valleys 242 that are separated by peaks 244 that are associated with the valleys 242. Specifically, the valleys 242 extend lengths along the periodic surface topology 240. The lengths of the valleys 242 extend approximately parallel to each other along the periodic surface topology 240. The peaks 244 extend lengths between the valleys 242 such that adjacent valleys 242 are separated by an associated peak 244 that extends therebetween.

When the electrical contacts 212 and 214 are mated together, the protrusion 218*a* is engaged with the mating side 216*a* of the mating element 216 at the peaks 244 of the periodic surface topology 240 of the mating side 216*a*. Specifically, a surface region 226 of the protrusion 218*a* is engaged with a surface region 224 of the mating side 216*a* that is entirely defined by the peaks 244. Although two peaks 244 are shown as engaged with the protrusion 218*a*, the surface region 224 may include any number of peaks 244 engaged with the surface region 226 of the protrusion 218*a*. The contact interface 220 is defined by the surface regions 224 and 226. Accordingly, the peaks 244 of the mating element 216 that are engaged with the protrusion 218*a* partially define the contact interface 220.

The contact interface 220 includes asperity junctions 228 where the contact interface 220 carries the greatest current density and asperity junctions 230 where the contact interface 220 has the greatest normal pressure. As shown herein, the asperity junctions 228 and the asperity junctions 230 overlap each other such that the mechanical distribution of normal pressure forces along the contact interface 220 coincides with the electrical distribution of electrical energy along the contact interface 220. In other words, the location(s) along the contact interface 220 where the current density is the greatest (i.e., the asperity junctions 228) overlap the location(s) along the contact interface 220 where the normal pressure is the greatest (i.e., the asperity junctions 230). For example, the asperity junctions 228 and 230 may overlap each other because the contact interface 220 has been more isolated (i.e., localized) to the surface regions 224 and 226 as compared to the broader surface areas of Hertzian contact interfaces of similarly sized mating elements. Moreover, using a periodic surface topology may create a low resistance contact that is nearly invariant against lateral position.

In the exemplary embodiment of the assembly 210, the asperity junctions 228 and 230 entirely overlap each other such that the mechanical distribution of normal pressure forces along the contact interface 220 completely coincides with the electrical distribution of electrical energy along the contact interface 220. But, in other embodiments, the asperity junctions 228 and 230 only partially overlap each other.

Figure 11:
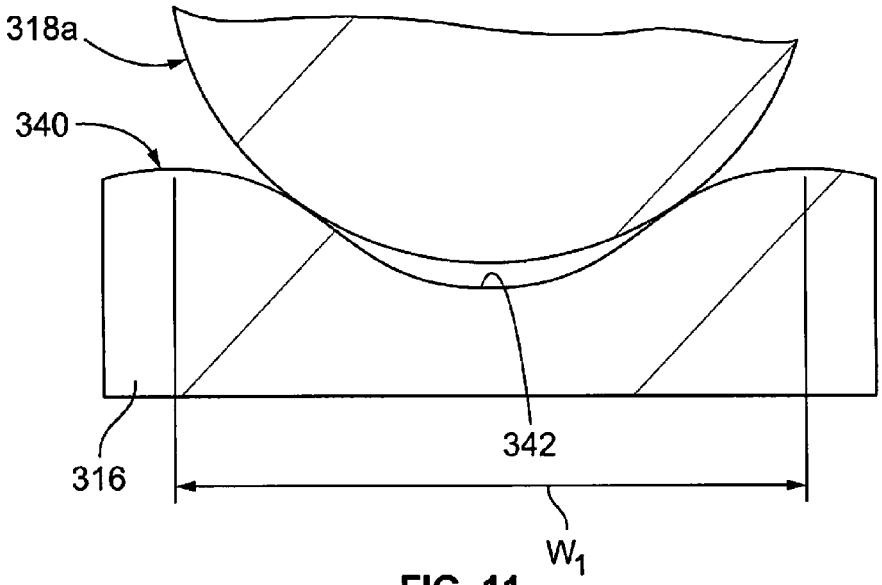
FIG. 11 is a cross-sectional view of another exemplary embodiment of an electrical contact assembly.

The area of the contact interface 220, the width W (FIG. 10) of the valleys 242 (i.e., the sinus wavelength of the periodic surface topology 240), the height H of the peaks 244, and/or the like may be selected to provide the asperity junctions 228 and 230 as at least partially overlapping (i.e., at least partially coincident). For example, the width W of the valleys 242 may be selected as less than approximately 0.8 times the radius of curvature $R_5$ of the protrusion 218*a* and greater than approximately 0.2 times the radius of curvature $R_5$ of the protrusion 218*a*, wherein the height H of the peaks 244 (i.e., twice the sinus amplitude of the periodic surface topology 240) is selected as greater than approximately 3% of the width W of the valleys 242. The sinus amplitude of the periodic surface topology 240 may be determined, for example, from a contact area using the equation:

$$1/r=1/r_{1L}+1/r_{1Q}+1/r_{2L}+1/r_{2Q},$$

where r is radius, 1 is the mating element 216, 2 is the mating element 218, L is the length radius, and Q is the cross radius. For example, FIG. 10 illustrates the case of a protrusion 218*a* having a radius of curvature of approximately 1.5 mm. In FIG. 10, the width W of the valleys 242 is selected as approximately 0.2 times the radius of curvature of the protrusion 218*a*, or approximately 0.3 mm, which gives a sinus amplitude of approximately 9 μm. FIG. 11 illustrates another embodiment of a protrusion 318*a* having a radius of curvature of approximately 1.5 mm. In FIG. 11, the width $W_1$ of the valleys 342 of a periodic surface topology 340 of a mating element 316 is selected as approximately 0.8 times the radius of curvature of the protrusion 318*a*, or approximately 1.2 mm, which gives a sinus amplitude of approximately 36 μm. The mating element 316 may be referred to herein as a "first" and/or a "second" mating element. The protrusion 318*a* may be referred to herein as a "curved protrusion" and/or a "spherical protrusion".

Referring again to FIGS. 9 and 10, an additional applied "roughness" profile (not shown) is optionally superimposed onto the periodic surface topology 240 of the mating side 216*a* of the mating element 216. In some embodiments, such a roughness profile does not deviate more than approximately 38% from the height H of the peaks 244 and/or from the width W of the valleys 242. In other words, such a roughness profile may not deviate more than 385 from the sinus wavelength and/or from twice the amplitude of the periodic surface topology 240.

Although only the mating side 216*a* of the mating element 216 is shown as including the periodic surface topology 240, in other embodiments, the protrusion 218*a* of the mating element 218 may include a periodic surface topology in addition or alternative to the periodic surface topology 240 of the mating side 216*a* of the mating element 216. In embodiments wherein both the protrusion 218*a* of the mating element 218 and the mating side 216*a* of the mating element 216 include periodic surface topologies, the periodic surface topologies may be angled at any angle with respect to each other when the mating elements 216 and 218 are engaged. Specifically, the lengths of the valleys 242 of the periodic surface topology 240 of the protrusion 218*a* may extend at any angle relative to the valleys (not shown) of the periodic surface topology (not shown) of the mating side 216*a* of the mating element 216. In some embodiments, the periodic surface topologies of the protrusion 218*a* and the mating side 216*a* will be oriented approximately perpendicular to the each other when the mating elements 216 and 218 are mated together. In other embodiments, the periodic surface topologies of the protrusion 218*a* and the mating side 216*a* are oriented approximately parallel or at an oblique angle relative to each other when the mating elements 216 and 218 are mated together. In embodiments wherein the periodic surface topologies of the protrusion 218*a* and the mating side 216*a* are oriented approximately parallel, the sinus wavelengths of the periodic surface topologies may be selected as approximately the same. A perfectly aligned pair of peaks from the mating elements 216 and 218 may create the most coincidence between the asperity junctions 228 and 230. In embodiments wherein the periodic surface topologies of the protrusion 218*a* and the mating side 216*a* are not oriented approximately parallel, the sinus wavelengths of the periodic surface topologies may be different or approximately the same.

Figure 12:
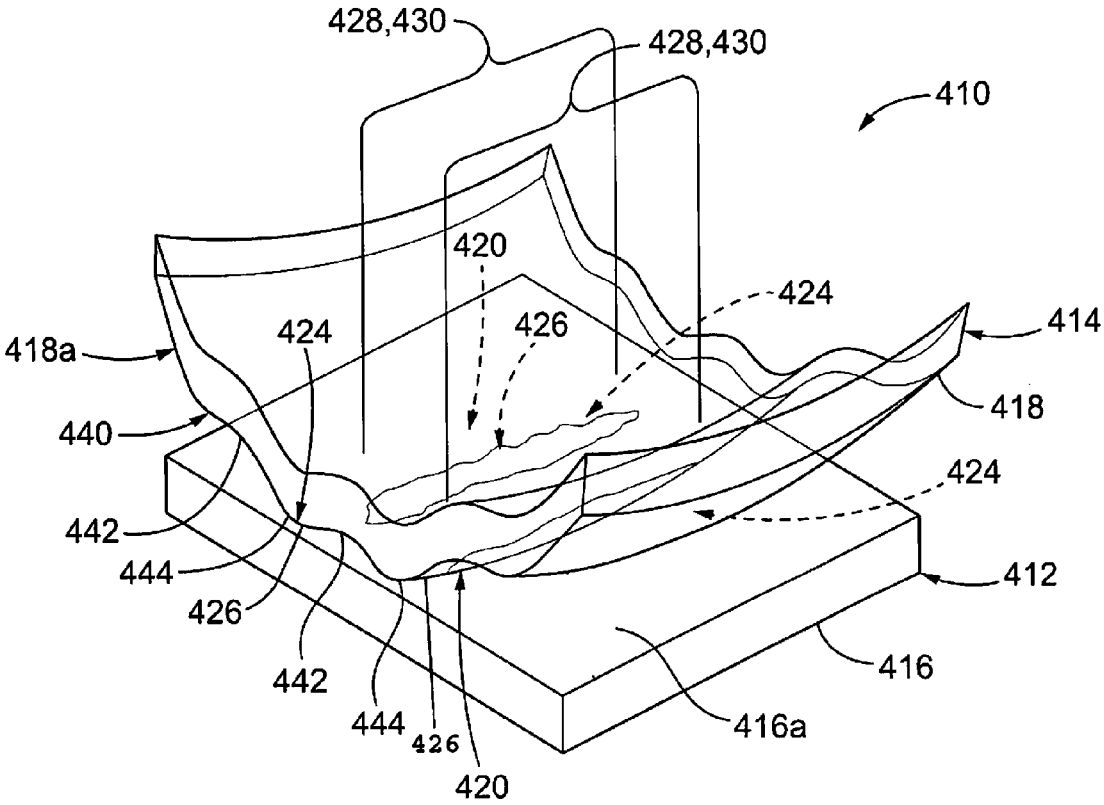
FIG. 12 is a perspective view of another exemplary embodiment of an electrical contact assembly.

FIG. 12 is a perspective view of another exemplary embodiment of an electrical contact assembly 410 illustrating an embodiment wherein a protrusion 418*a* has a periodic surface topology 440. The assembly 410 includes a pair of complementary electrical contacts 412 and 414 that include respective mating elements 416 and 418 that engage each other at a contact interface 420 to mate the electrical contacts 412 and 414 together. The electrical contacts 412 and 414 may each be referred to herein as a "first" and/or a "second" electrical contact. Each of the mating elements 416 and 418 may be referred to herein as a "first" and/or a "second" mating element.

The mating element 416 of the electrical contact 412 includes an approximately planar surface 416*a*. The mating element 418 of the electrical contact 414 includes a protrusion 418*a*. The protrusion 418*a* has the periodic surface topology 440, which includes valleys 442 that are separated by peaks 444 that are associated with the valleys 442. The protrusion 418*a* may be referred to herein as a "curved protrusion" and/or a "spherical protrusion".

When the electrical contacts 412 and 414 are mated together, the protrusion 418*a* is engaged with the approximately planar surface 416*a* at the peaks 444 of the periodic surface topology 440 of the protrusion 418*a*. Specifically, a surface region 426 of the protrusion 418*a* that is entirely defined by the peaks 444 is engaged with the approximately planar surface 416*a* at a surface region 424 of the surface 416*a*. Although two peaks 444 are shown as engaged with the surface 416*a*, the surface region 426 may include any number of peaks 444 engaged with the surface region 224 of the surface 416*a*. The contact interface 420 is defined by the surface regions 424 and 426, such that the peaks 444 of the mating element 416 that are engaged with the protrusion 418*a* define a portion of the contact interface 420.

The contact interface 420 includes asperity junctions 428 where the contact interface 420 carries the greatest current density and asperity junctions 430 where the contact interface 420 has the greatest normal pressure. The asperity junctions 428 and the asperity junctions 430 at least partially overlap each other such that the mechanical distribution of normal pressure forces along the contact interface 420 at least partially coincides with the electrical distribution of electrical energy along the contact interface 420.

Figure 13:
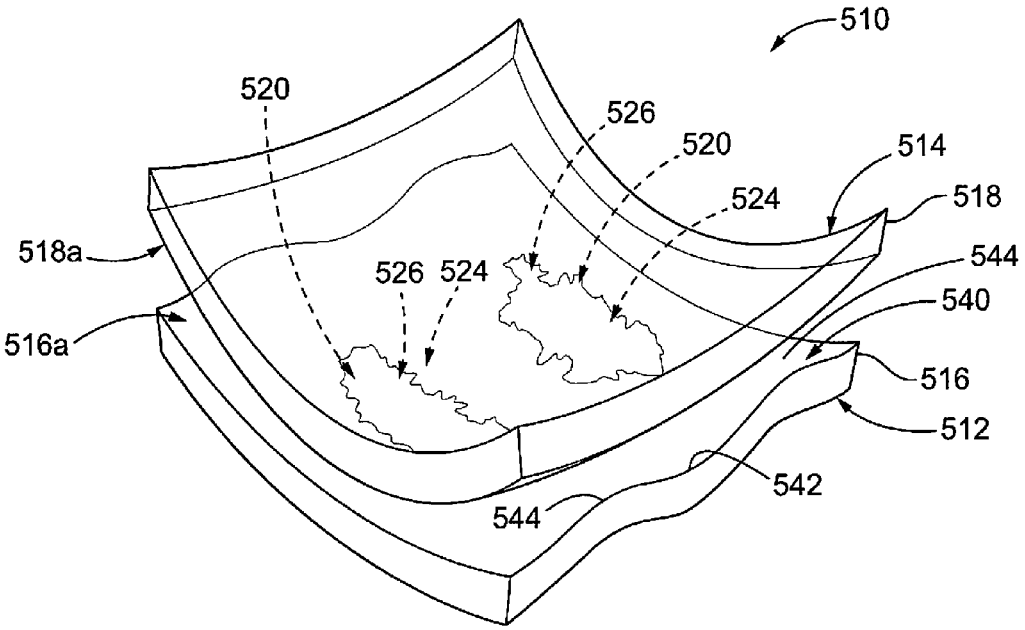
FIG. 13 is a perspective view of another exemplary embodiment of an electrical contact assembly.

FIG. 13 is a perspective view of another exemplary embodiment of an electrical contact assembly 510 illustrating an embodiment wherein a mating element 516 having a concave shape includes a periodic surface topology 540. The assembly 510 includes a pair of complementary electrical contacts 512 and 514 that include respective mating elements 516 and 518 that engage each other at a contact interface 520 to mate the electrical contacts 512 and 514 together. The electrical contacts 512 and 514 may each be referred to herein as a "first" and/or a "second" electrical contact. Each of the mating elements 516 and 518 may be referred to herein as a "first" and/or a "second" mating element.

The mating element 518 of the electrical contact 514 includes a protrusion 518*a*. The mating element 516 of the electrical contact 512 includes a mating side 516*a* having a concave shape. The mating side 516*a* of the mating element 516 includes the periodic surface topology 540, which includes valleys 542 that are separated by associated peaks 544. The protrusion 518*a* may be referred to herein as a "curved protrusion" and/or a "spherical protrusion".

When the electrical contacts 512 and 514 are mated together, the protrusion 518*a* is engaged with the mating side 516*a* at the peaks 544 of the periodic surface topology 540 of the mating side 516*a*. Specifically, a surface region 526 of the protrusion 518*a* is engaged with a surface region 524 of the mating side 516*a* that is entirely defined by the peaks 544. Although two peaks 544 are shown as engaged with the protrusion 518*a*, the surface region 524 may include any number of peaks 544 engaged with the surface region 526 of the protrusion 518*a*. The contact interface 520 is defined by the surface regions 524 and 526 such that the peaks 544 of the mating element 516 that are engaged with the protrusion 518*a* partially define the contact interface 520.

The contact interface 520 includes asperity junctions 528 where the contact interface 520 carries the greatest current density and asperity junctions 530 where the contact interface 520 has the greatest normal pressure. The asperity junctions 528 and the asperity junctions 530 at least partially overlap each other such that the mechanical distribution of normal pressure forces along the contact interface 520 at least partially coincides with the electrical distribution of electrical energy along the contact interface 520.

Figure 14:
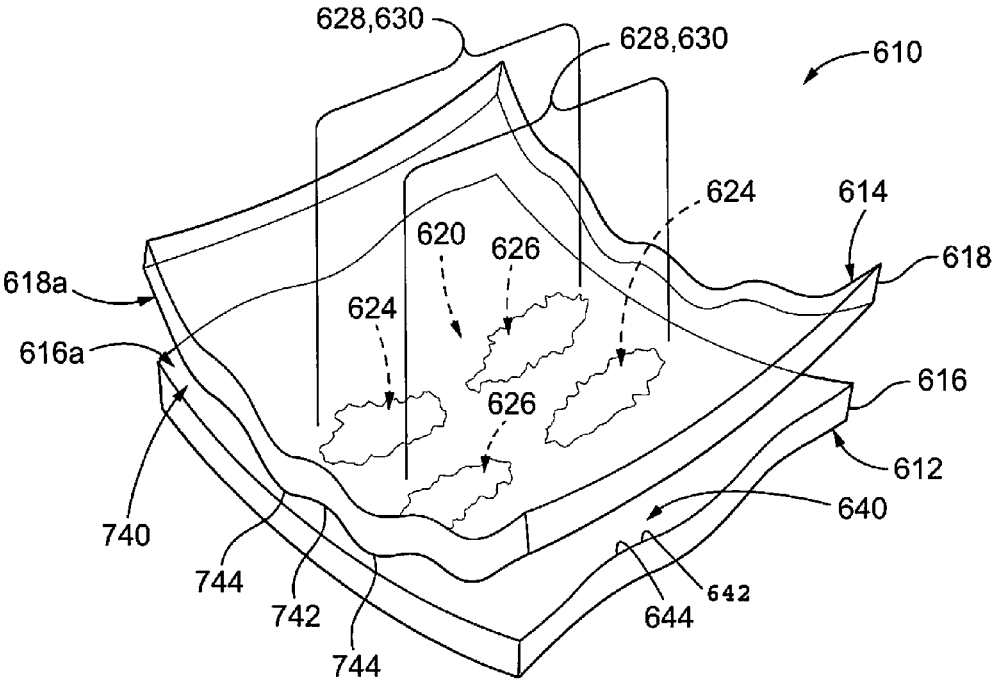
FIG. 14 is a perspective view of another exemplary embodiment of an electrical contact assembly.

FIG. 14 is a perspective view of another exemplary embodiment of an electrical contact assembly 610 illustrating an embodiment wherein both mating elements 616 and 618 include periodic surface topologies 640 and 740, respectively. The assembly 610 includes a pair of complementary electrical contacts 612 and 614 that include the respective mating elements 616 and 618, which engage each other at a contact interface 620 to mate the electrical contacts 612 and 614 together. The electrical contacts 612 and 614 may each be referred to herein as a "first" and/or a "second" electrical contact. Each of the mating elements 616 and 618 may be referred to herein as a "first" and/or a "second" mating element.

The mating element 618 of the electrical contact 614 includes a protrusion 618*a*. The mating element 616 of the electrical contact 612 includes a mating side 616*a* having a concave shape. The mating side 616*a* of the mating element 516 and the protrusion include the periodic surface topologies 640 and 740, respectively. The periodic surface topologies 640 and 740 include respective valleys 642 and 742 that are separated by associated peaks 644 and 744, respectively. The protrusion 618*a* may be referred to herein as a "curved protrusion" and/or a "spherical protrusion".

When the electrical contacts 612 and 614 are mated together, the protrusion 618*a* is engaged with the mating side 616*a* such that the peaks 644 of the periodic surface topology 640 of the mating side 516*a* are engaged with the peaks 744 of the periodic surface topology 740 of the protrusion 618*a*. Specifically, a surface region 626 of the protrusion 518*a* that is entirely defined by the peaks 744 is engaged with a surface region 624 of the mating side 616*a* that is entirely defined by the peaks 644. In the exemplary embodiment of the assembly 610, the periodic surface topologies 644 and 744 are oriented approximately perpendicular to each other. Specifically, the valleys 644 of the periodic surface topology 640 are oriented approximately perpendicular to the valleys 744 of the periodic surface topology 740. Although two peaks 644 are shown as engaged with two peaks 744, any number of the peaks 644 may be engaged with any number of the peaks 744. The contact interface 620 is defined by the surface regions 624 and 626 such that the peaks 644 and 744 define the contact interface 520.

The contact interface 620 includes asperity junctions 628 where the contact interface 620 carries the greatest current density and asperity junctions 630 where the contact interface 620 has the greatest normal pressure. The asperity junctions 628 and the asperity junctions 630 at least partially overlap each other such that the mechanical distribution of normal pressure forces along the contact interface 620 at least partially coincides with the electrical distribution of electrical energy along the contact interface 620.

The various electrical contact assembly embodiments described and/or illustrated herein may provide contact interfaces where the asperity junctions within the contact interface that carry the greatest current density overlap (i.e., coincide with) the asperity junctions within the contact interface that have the greatest normal pressure. The coincidence of the asperity junctions that carry greatest current density and the asperity junctions that have the greatest normal pressure may result in a lower contact resistance of the electrical contacts of the assembly and/or may lead to the electrical contacts having lower normal forces, for example as compared to electrical contact assemblies having Hertzian type contact interfaces. Moreover, The coincidence of the asperity junctions that carry greatest current density and the asperity junctions that have the greatest normal pressure may result in less localized thermal response, for example as compared to electrical contact assemblies having Hertzian type contact interfaces. Technical effects of the various embodiments may include, but are not limited to, reducing contact resistance, reducing normal forces, and/or reducing localized thermal responses. The reduction of contact resistance and/or normal forces may be best for mating elements that engage each other at non-noble metal finished surfaces. A lesser effect may be seen when mating more noble metal finished surfaces. The reduction of contact resistance and/or normal forces may be seen both when the mating elements have substantially the same materials at the contact interface (e.g., when mating like finishes) and when the mating elements have different materials at the contact interface (e.g., when mating different finishes).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact assembly comprising:

a first electrical contact having a first mating element, the first mating element comprising a curved depression, the curved depression being a groove that is elongated to extend a length along the first mating element, the groove having a rim defined by two opposing rim segments that extend the length of the groove; and a second electrical contact having a second mating element, the second mating element comprising a curved protrusion, the first and second electrical contacts being configured to mate together at the first and second mating elements such that the first and second mating elements engage each other at a contact interface, the curved protrusion being configured to be partially received into the groove when the first and second mating elements are engaged, the curved protrusion engaging the groove at the rim segments along a contact portion of the length of the rim, the curved protrusion not engaging the groove radially interior of the rim segments, the curved protrusion not engaging the groove along a non-contact portion of the length of the rim adjacent to the contact portion of the length;

wherein a distribution of contact pressure across the contact interface at least partially coincides with a distribution of electrical current flow across the contact interface.

2. The assembly of claim 1, wherein an asperity junction wherein the contact interface carries the greatest amount of electrical current flow at least partially coincides with an asperity junction wherein the contact interface has the greatest contact pressure.

3. The assembly of claim 1, wherein the distribution of contact pressure across the contact interface completely coincides with the distribution of electrical current flow across the contact interface.

4. The assembly of claim 1, wherein the curved protrusion of the second mating element has a greater radius of curvature than the groove of the first mating element.

5. The assembly of claim 1, wherein the groove of the first mating element is a cylindrical groove, the curved protrusion of the second mating element being a spherical protrusion that is configured to be partially received into the cylindrical groove when the first and second mating elements are engaged, wherein the spherical protrusion of the second mating element has a greater radius of curvature than the cylindrical groove of the first mating element.

6. The assembly of claim 1, wherein the rim segments of the groove along the contact portion of the length of the rim define an entirety of a portion of the contact interface that is defined by the first mating element.

7. The assembly of claim 1, wherein the curved protrusion of the second mating element only engages the first mating element at the rim of the groove.

8. The assembly of claim 2, wherein the asperity junction in which the contact interface carries the greatest amount of electrical current flow and the asperity junction in which the contact interface has the greatest contact pressure entirely overlap each other.

9. An electrical contact assembly comprising:

a first electrical contact having a first mating element, the first mating element comprising an approximately planar surface; and a second electrical contact having a second mating element, the second mating element comprising a curved protrusion having a tip that includes a depression extending therein, the depression having a rim that defines a transition between the curved protrusion and the depression, the first and second electrical contacts being configured to mate together at the first and second mating elements such that the first and second mating elements engage each other at a contact interface, the approximately planar surface of the first mating element engaging the curved protrusion of the second mating element at the rim of the depression, the first mating element not engaging the depression of the curved protrusion radially interior of the rim;

wherein the contact interface comprises a first asperity junction where the contact interface has the greatest current density and a second asperity junction where the contact interface has the greatest normal load, the first and second asperity junctions at least partially overlapping each other.

10. The assembly of claim 9, wherein the first and second asperity junctions entirely overlap each other.

11. The assembly of claim 9, wherein the rim defines an entirety of a portion of the contact interface that is defined by the second mating element.

12. The assembly of claim 9, wherein the depression on the tip of the curved protrusion is a groove that extends a length along the tip, the rim of the depression being a rim of the groove, the curved protrusion being configured to engage the approximately planar surface of the first mating element at the rim of the groove, portions of the groove interior of the rim configured to not engage the first mating element.

13. The assembly of claim 9, wherein the approximately planar surface of the first mating element only engages the curved protrusion of the second mating element at the rim of the depression.

14. The assembly of claim 9, wherein the curved protrusion of the second mating element is a spherical protrusion.

15. An electrical contact assembly comprising:

a first electrical contact having a first mating element; and a second electrical contact having a second mating element that comprises a curved surface, the curved surface of the second mating element having a periodic surface topology that includes approximately parallel peaks protruding from the curved surface, the peaks being elongated to extend along a length, adjacent peaks being separated from each other by valleys, the first and second electrical contacts being configured to mate together at the first and second mating elements such that the first and second mating elements engage each other at a contact interface that is at least partially defined by the peaks, wherein the first mating element is configured to engage at least two of the peaks of the periodic surface topology, the first mating element configured to not engage the at least one valley disposed between the at least two peaks that the first mating element engages.

16. The assembly of claim 15, wherein the curved surface of the second mating element is a curved protrusion that includes the periodic surface topology, the first mating element of the first electrical contact comprising an approximately planar surface that defines a portion of the contact interface.

17. The assembly of claim 15, wherein the curved surface of the second mating element is a curved protrusion that includes the periodic surface topology, the first mating element of the first electrical contact includes a mating side having a concave shape that defines a portion of the contact interface.

18. The assembly of claim 15, wherein the first mating element of the first electrical contact also includes a periodic surface topology that includes approximately parallel peaks that are separated by valleys, the peaks of the periodic surface topology of the first mating element engaging the peaks of the periodic surface topology of the second mating element when the first and second electrical contacts are mated together, the peaks of the periodic surface topology of the first mating element not engaging the valleys of the periodic surface topology of the second mating element.

19. The assembly of claim 15, wherein the first mating element of the first electrical contact comprises a curved protrusion that defines a portion of the contact interface such that the curved protrusion is configured to engage at least two of the peaks of the periodic surface topology of the second mating element without engaging the at least one valley disposed between the at least two peaks that the curved protrusion engages.

20. The assembly of claim 19, wherein the curved protrusion of the first mating element has a radius of curvature, a width of the valleys of the periodic surface topology of the second mating element each being greater than approximately 0.2 times the radius of curvature of the curved protrusion and less than approximately 0.8 times the radius of curvature of the curved protrusion.

21. The assembly of claim 15, wherein the curved surface of the second mating element has a concave shape, the first mating element of the first electrical contact engaging at least two of the peaks of the periodic surface topology along the concave curved surface without engaging the one or more valleys between the at least two peaks.

22. An electrical contact assembly comprising:

a first electrical contact having a first mating element, the first mating element having a periodic surface topology that includes approximately parallel peaks with valleys extending between and separating adjacent peaks, the peaks and valleys being elongated to extend along a length, the first mating element being a curved protrusion, the peaks of the periodic surface topology protruding from the curved protrusion; and a second electrical contact having a second mating element, the second mating element having a periodic surface topology that includes approximately parallel peaks with valleys extending between and separating adjacent peaks, the peaks and valleys being elongated to extend along a length, the second mating element having a curved concave surface, the peaks of the periodic surface topology of the second mating element protruding from the curved concave surface, wherein the first and second electrical contacts are configured to mate together at the first and second mating elements, the peaks of the periodic surface topology of the first mating element engaging the peaks of the periodic surface topology of the second mating element when the first and second electrical contacts are mated together.

23. The assembly of claim 22, wherein the valleys of the periodic surface topology of the first mating element extend approximately perpendicular to the valleys of the periodic surface topology of the second mating element when the first and second electrical contacts are mated together.

24. The electrical contact assembly of claim 22, wherein the peaks of the periodic surface topology of the first mating element do not engage the valleys of the periodic surface topology of the second mating element, and the peaks of the periodic surface topology of the second mating element do not engage the valleys of the periodic surface topology of the first mating element when the first and second electrical contacts are mated together.

25. The electrical contact assembly of claim 22, wherein the peaks of the periodic surface topology of the first mating element extend transverse to the peaks of the periodic surface topology of the second mating element when the first and second electrical contacts are mated together.

26. The electrical contact assembly of claim 22, wherein the curved concave surface of the second mating element has a greater radius of curvature than the curved protrusion of the first mating element.

* * * * *